US009464343B2

(12) United States Patent
Kamoshida et al.

(10) Patent No.: US 9,464,343 B2
(45) Date of Patent: Oct. 11, 2016

(54) NI-BASED CASTING ALLOY AND STEAM TURBINE CASTING PART USING THE SAME

(71) Applicant: Mitsubishi Hitachi Power Systems, Ltd., Nishi-ku, Yokohama, Kanagawa (JP)

(72) Inventors: Hironori Kamoshida, Tokyo (JP); Shinya Imano, Tokyo (JP); Kenichi Murata, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 0 days.

(21) Appl. No.: 14/068,926

(22) Filed: Oct. 31, 2013

(65) Prior Publication Data

US 2014/0127525 A1 May 8, 2014

(30) Foreign Application Priority Data

Nov. 7, 2012 (JP) ..... 2012-245469

(51) Int. Cl.
*C22C 19/05* (2006.01)

(52) U.S. Cl.
CPC ..... *C22C 19/055* (2013.01); *C22C 19/056* (2013.01); *Y10T 428/12* (2015.01)

(58) Field of Classification Search
CPC .. C22C 19/057; C22C 19/056; C22C 19/055
USPC ..... 420/448
See application file for complete search history.

(56) References Cited

U.S. PATENT DOCUMENTS

| | | | | |
|---|---|---|---|---|
| 3,046,108 | A | 7/1962 | Eiselstein | |
| 3,160,500 | A | 12/1964 | Eiselstein et al. | |
| 3,619,183 | A | 11/1971 | Olson et al. | |
| 4,400,211 | A * | 8/1983 | Kudo et al. | 420/443 |
| 2009/0291016 | A1* | 11/2009 | Yamada et al. | 420/586 |
| 2010/0310411 | A1* | 12/2010 | Ohsaki et al. | 420/443 |
| 2013/0052474 | A1 | 2/2013 | Imano et al. | |
| 2013/0255442 | A1 | 10/2013 | Imano et al. | |

FOREIGN PATENT DOCUMENTS

| | | | |
|---|---|---|---|
| EP | 0 081 091 | A2 | 6/1983 |
| EP | 0 247 577 | A1 | 12/1987 |
| EP | 0 365 884 | A1 | 5/1990 |
| EP | 2 128 283 | A2 | 12/2009 |
| EP | 2 292 807 | A1 | 3/2011 |
| EP | 2 511 389 | A1 | 10/2012 |
| GB | 2 084 188 | A | 4/1982 |
| JP | 57-47842 | A | 3/1982 |
| JP | 2013-44252 | A | 3/2013 |
| JP | 2013-208628 | A | 10/2013 |

OTHER PUBLICATIONS

European Search Report dated Mar. 14, 2014 (Ten (10) pages).

* cited by examiner

*Primary Examiner* — Jessee Roe

(74) *Attorney, Agent, or Firm* — Crowell & Moring LLP

(57) ABSTRACT

To provide, in producing a large product through casting, a Ni-based alloy with a composition that minimizes variations in strength at different locations even when the solidification rate becomes slow and the amount of micro segregation increases. The Ni-based casting alloy of the present invention has a composition of, in mass %, 0.001% to 0.1% C, 15% to 23% Cr, 0% to 11.5% Mo, 3% to 18% W, 5 or less % Fe, 10 or less % Co, 0.4 or less % Ti, 0.4 or less % Al, and Nb and Ta (where 0.5%≤Nb+Ta≤4.15%), in which 7%≤Mo+1/2W≤13% is satisfied, and the composition also contains inevitable impurities and Ni.

3 Claims, 3 Drawing Sheets

NI-BASED CASTING ALLOY AND STEAM TURBINE CASTING PART USING THE SAME

BACKGROUND

1. Technical Field

The present invention relates to a Ni-based casting alloy and a steam turbine casting part using the same.

2. Background Art

In recent years, the development of thermal power plants with steam temperature of 700° C. or higher (A-USC, Advanced-Ultra Super Critical) has been advanced with the aim of increasing the efficiency of coal-fired power plants. For high-temperature parts of steam turbines that have been developed up to the present, iron-based 9Cr, 12Cr heat resistant ferritic steel, and the like have been used. However, as the upper limit of the steam temperature for heat resistant ferritic steel in the use environment is said to be 650° C., application of heat resistant ferritic steel to a 700° C.-level steam turbine is considered difficult. Therefore, application of a Ni-based alloy to a high-temperature part of a 700° C.-level steam turbine is envisaged. Many of Ni-based alloys are able to, when elements such as Al and Ti, as well as Cr, are added thereto and adequate heat treatment (i.e., aging heat treatment) is applied, have precipitated (i.e, precipitation strengthened) therefrom intermetallic compounds that are stable at elevated temperatures. Thus, high strength properties are exhibited at elevated temperatures. However, elements such as Al, Ti, and Nb that contribute to an increase in strength at elevated temperatures are problematic in that they will easily become segregated. However, for the materials of rotor shafts and the like, for example, it is possible to obtain a uniform part through casting by producing an ingot using a melting method that uses a double-melt process, such as VIM (Vacuum-Induction Melting)+ESR (Electroslag Remelting) or VIM+VAR (Vacuum-Arc Remelting), or a triple-melt process of VIM+ESR+VAR.

Meanwhile, steam turbine casings, steam turbine valve parts, and the like, which have large sizes and complicated shapes, are produced through casting with the use of large casting molds. However, as such casings and parts have complicated shapes, the aforementioned melting method is difficult to use. Further, when a casting method that employs a large casting mold is used, it is difficult to control the casting atmosphere. Thus, Al and Ti, which are active elements, may oxidize, or it might be difficult to control the components, which could result in defects and outside-of-specifications that would adversely affect the material characteristics of the obtained parts.

Accordingly, it has been considered to, even in the case of using the same Ni-based alloy for a large part to be produced through casting, apply an alloy that has been strengthened not through precipitation strengthening but through solid-solution strengthening, with the use of few active elements such as Al. As a candidate material therefor, Alloy 625 (Patent Document 1 and Patent Document 2) is known. The inventors prepared prototypes of thick specimens with the use of Alloy 625, supposing thick parts such as casings, and were able to confirm that the specimens had excellent manufacturability (without macro defects being generated therein) and had strength at elevated temperatures (i.e., have creep characteristics). However, when the prototypes were crushed for examination purposes, it was found that the grain structures were coarse and a large degree of micro segregation was present. In particular, with regard to micro segregation, it was found that there were large variations in alloy components between the dendrite core portion and the dendrite boundary portion, and some portions did not even satisfy a predetermined concentration. When the hardness was measured for the regions with such large variations in alloy components, some were found to be hard while others were not. Thus, such specimens are estimated to lack uniformity in strength. This may adversely affect a material that is required to be reliable over the long term, such as a steam turbine part, for example.

Patent Document 1: U.S. Pat. No. 3,046,108

Patent Document 1: U.S. Pat. No. 3,160,500

SUMMARY

Variations in strength resulting from micro segregation are generated by the distribution of alloy components that occurs when liquid alloys solidify. This results from the inhomogeneous concentration of the solid-solution strengthening elements of the alloy components. Accordingly, the present invention aims to provide, in producing a large product through casting, a Ni-based alloy with a composition that minimizes variations in strength at different locations even when the solidification rate becomes slow and the extent of micro segregation increases.

In order to solve the aforementioned problems, the Ni-based casting alloy of the present invention has a composition of, in mass %, 0.001% to 0.1% C, 15% to 23% Cr, 0% to 11.5% Mo, 3% to 18% W, 5 or less % Fe, 10 or less % Co, 0.4 or less % Ti, 0.4 or less % Al, and Nb and Ta (where 0.5%≤Nb+Ta≤4.15%), in which 7%≤Mo+1/2W≤13% is satisfied, and the composition also contains inevitable impurities and Ni. Using an alloy with such components can produce a large casting part for a steam turbine.

According to the present invention, even when a large casting part is produced, it is possible to suppress variations in strength due to micro segregation, and thus provide a Ni-based casting alloy with uniform strength properties. Other objects, structures, and advantages will become apparent from the following description of embodiments.

DETAILED DESCRIPTION

Hereinafter, the present invention will be specifically described.

A Ni-based casting alloy in accordance with the present invention has a chemical composition of, in mass %, 0.001% to 0.1% C, 15% to 23% Cr, 0% to 11.5% Mo, 3% to 18% W, 5 or less % Fe, 10 or less % Co, 0.4 or less % Ti, 0.4 or less % Al, and Nb and Ta (where 0.5%≤Nb+Ta≤4.15%), and the composition also contains inevitable impurities and Ni. With regard to the chemical composition of Mo and W, 7%≤Mo+1/2W≤13% is satisfied. Examples of a part that uses such an alloy include a large casting such as a steam turbine casing or valve or a component part thereof.

Figure 1:
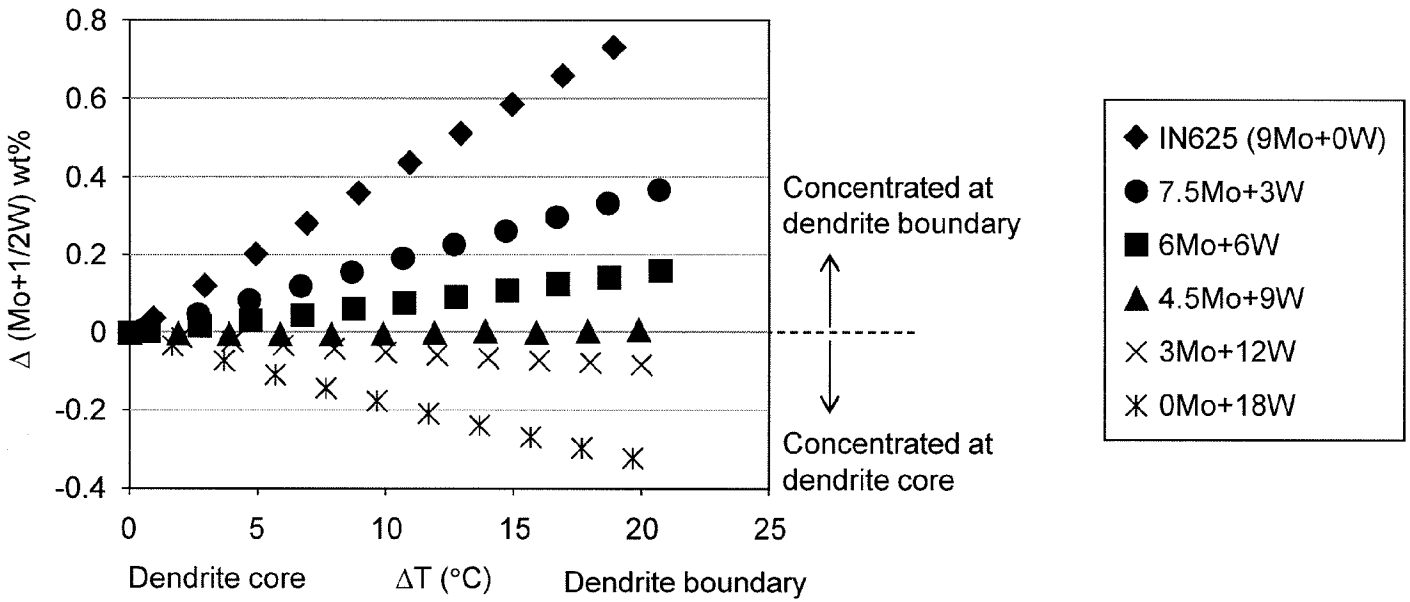
FIG. 1 is a graph illustrating the characteristics of the present invention.

The inventors, focusing on Alloy 625, initially produced a large casting material (with a weight of two tons) as a Ni-based alloy for a large casting part. Consequently, they succeeded in producing a casting without macro defects such as Freckle defects being generated therein. However, the grains were coarse, and some of them were over 70 mm. Further, when structural observation and compositional analysis were conducted using a scanning electron microscope (SEM) and an energy-dispersive X-ray spectrometer (EDX), it was found that the dendrite core and the dendrite boundary had different chemical compositions. That is, it was found that at the dendrite boundary, the amounts of Mo and Nb were higher than their inspection certificate values (for the entire composition), while at the dendrite core, the amounts of Mo and Nb were lower than their inspection certificate values. This is due to the difference in distribution coefficients that occurs in the solidification process. Mo and Nb have a tendency to be distributed throughout the liquid phase in the solidification process, and thus are concentrated at the dendrite boundary portion that becomes the finally solidified portion. Accordingly, the alloy components are concentrated at the dendrite boundary portion, and thus the strength becomes greater (i.e., the hardness becomes greater) at the dendrite boundary, while the strength becomes lower (i.e., the hardness becomes lower) at the dendrite core. FIG. 1 provides an example illustrating the concept of the present invention. The ordinate axis indicates fluctuations of the composition of the solid-solution strengthening elements (Mo, W), and indicates the difference (Δ(Mo+1/2W)) between the value of (Mo+1/2W) at each solidifying temperature and the value at the liquidus point. The abscissa axis indicates the difference ΔT in temperature from the liquidus temperature. In FIG. 1, the abscissa axis is plotted up to a temperature at which a solid phase fraction of 0.35 is reached. For the conventional Alloy 625, it can be seen that Δ(Mo+1/2W) increases as Mo becomes concentrated toward the liquid-phase side after the solidification starts, and thus that the solid-solution strengthening element is concentrated at the dendrite boundary. Thus, the inventors, as a result of studying the uniform distribution of the solid-solution strengthening element across the dendrite core and the dendrite boundary by suppressing a change in concentration (Δ(Mo+1/2W)), found that the value of Δ(Mo+1/2W) becomes closer to zero when W, which can replace Mo, is added. By minimizing the difference in concentration of the alloy components between the dendrite core portion and the dendrite boundary portion through such material design, it becomes possible to make the mechanical properties uniform.

Hereinafter, the range of the composition ratio of each component contained in the alloy of the present invention will be described.

(C)

C is an element that precipitates carbide such as MC, M23C6, and M6C, and contributes to an increase in the strength of the grain boundaries by precipitating carbide not only within the grains but also at the grain boundaries. Such effect can be seen when the C content is 0.001% or greater, and preferably 0.005% or greater. However, when the C content is over 0.1%, carbide with coarse grains will precipitate in large quantities, which could result in embrittlement. Thus, the C content is preferably not less than 0.001%, particularly preferably, not less than 0.005% and not greater than 0.1%, and more preferably, not less than 0.02% and not greater than 0.08%.

(Cr)

Cr forms a scale of $Cr_2O_3$ on the surface. $Cr_2O_3$ serves as a protective scale with high oxidation resistance and corrosion resistance. As the present invention is applied to a high-temperature part of a steam turbine, the Cr content needs to be not less than 15% so that the aforementioned properties are exhibited. However, when the Cr content is too high, the sigma phase will precipitate, which could reduce the ductility of the material. From such viewpoint, the Cr content is desirably not greater than 23%.

(Mo)

Mo dissolves in the parent phase of Ni, and contributes to an increase in the strength of the parent phase. In order for Mo to be distributed throughout the liquid phase during solidification, adjustment of the amounts of Mo and W (described below) is necessary. The preferable range of Mo is 0% to 11.5%.

(W)

W also dissolves in the parent phase of Ni, and contributes to an increase in the strength of the parent phase. In order for W to be distributed in the solid phase during solidification, keeping a balance between the amounts of W and Mo is important. The preferable range of W is 3% to 18%.

(Mo+1/2W)

As described above, Mo and W have, by dissolving in the parent phase, the effect of increasing the strength of the parent phase. However, when Mo and W solidify, the distribution properties thereof have the opposite effect. Accordingly, Mo and W are desirably added in the range represented by the following formula in addition to each of the ranges of Mo and W described above.

$$7\% \leq Mo+1/2W \leq 13\%$$

When the value of Mo+1/2W is less than or equal to 7%, a sufficient solid-solution strengthening effect is not obtained. Meanwhile, when the value of Mo+1/2W is higher, the phase stability of the parent phase will be lower, and an embrittlement phase such as the sigma phase will be likely to precipitate. When the value of Mo+1/2W is over 10, such a phenomenon becomes particularly noticeable. Thus, in that case, the content of Cr, which is also a sigma phase generating element, is desirably reduced to 20% or less. Further, when the value of Mo+1/2W is over 13%, the phase stability will be significantly lower. Thus, the upper limit is set at 13%. When Mo and W are added such that they satisfy a plurality of ranges described above, it is possible to produce a large casting part with uniform strength as a large casting material such as a steam turbine casing or a steam turbine valve.

(Nb+Ta)

Nb and Ta are in the same group of the periodic table, and the functions they perform in alloys are similar. Thus, Nb and Ta are mutually interchangeable. These are the elements that precipitate the gamma prime phase and the gamma double prime phase, and are elements that increase strength at elevated temperatures. However, when such elements are exposed to high temperatures for a long period of time, the delta phase will precipitate. Further, such elements have a tendency to be distributed throughout the liquid phase during solidification and to be concentrated at the dendrite boundary. Although the delta phase contributes to an increase in the strength at elevated temperatures, if it precipitates in excessive quantities, ductility will decrease.

Thus, the upper limit of the total content of Nb+Ta is set at 4.15%. Further, considering the possibility that such elements will be concentrated at the dendrite boundary, the upper limit of the total content of Nb+Ta is desirably 3.5% or less. With regard to the lower limit, it was confirmed that the advantageous effect of the present alloy is obtained when the content of Nb+Ta is 0.5% or greater. Ta is a scarce element and is expensive. Thus, even if Nb is added alone, there will be no problem.

(Fe)

Fe has higher ductility than Ni, and is less expensive than the other elements. Thus, Fe contributes to a cost reduction of the material. However, when Fe is added in extremely large quantities, the material will have deteriorated properties at elevated temperatures. Thus, the upper limit of Fe is set at 5%.

(Co)

Co is an element that completely dissolves in Ni, and has a high stably solid-solution strengthening effect. However, as the Co element is expensive, if the Co content is too high, the cost will increase. Therefore, the Co content is preferably less than or equal to 10%. Alternatively, there would be no problem even if there were to be no Co.

(Al, Ti)

Al and Ti will dissolve in the gamma double prime phase, and contribute to an increase in strength. However, as such elements are active against oxygen, if a large casting part is produced using such elements, the part will be likely to have oxides generated therein. Such oxides, which can be defects, are preferably as low in quantity as possible. The upper limit for each of Al and Ti is set at 0.4%.

Next, examples of the application of the Ni-based casting alloy of the present invention will be described. The alloy of the present invention is applied to a thick steam turbine casting part or a large casting material. For example, a piping part called an elbow that joins a valve and a turbine casing has a thickness of 50 mm or greater. The turbine casing and the valve casing are parts with large sizes and complicated shapes, and each has a weight of one ton or greater and a thickness of 50 mm or greater. Such parts are produced through casting. However, as such parts are thick and large as described above, the solidification rate is slow, and micro segregation tends to increase. Such parts, which are the portions through which high-temperature, high-pressure steam flows, are required to be reliable for long periods of time. Thus, from also the perspective of the strength properties, applying the alloy of the present invention can provide a part with uniform strength.

EXAMPLES

Although the present invention will be hereinafter described in further detail with reference to examples and comparative examples, the present invention is not limited thereto.

Figure 2:
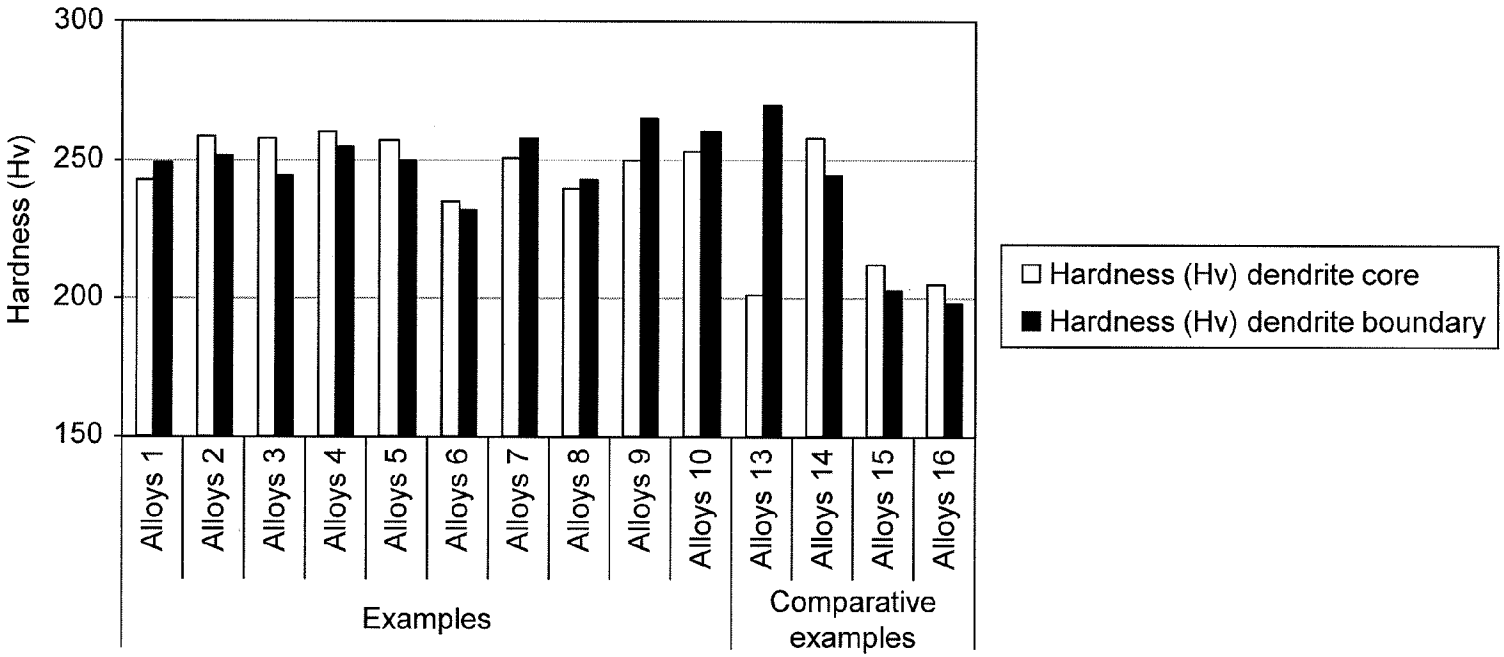
FIG. 2 is a graph showing the measurement results of the hardness of alloys of examples and comparative examples.
Figure 3:
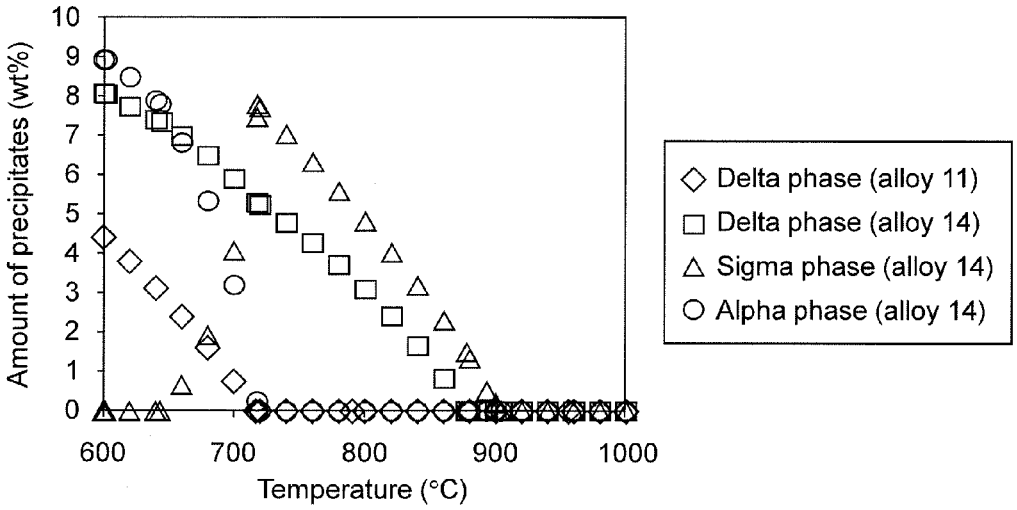
FIG. 3 is a graph showing the results of computation simulation of the precipitation behavior of intermetallic compounds alloy 11 and alloy 14.

Table 1 shows the alloy compositions of samples. Alloy 13 in Table 1 is an alloy corresponding to Alloy 625. Ingots with such compositions were dissolved using a testing device, which simulates the large steel ingot manufacturing properties, so as to produce specimens with coarse structures with the same level of grains as those of large casting materials. After the structures were observed, the hardness of the dendrite core portions and the dendrite boundary portions was measured. FIG. 2 shows the results of the measurement of hardness. With regard to alloys 1 to 10 of the examples, substantially uniform hardness is obtained. However, alloy 13 of a comparative example has large variations in hardness. Alloy 14 also tends to have large variations in hardness though they are not as great as those of alloy 13 of another comparative example, and alloy 14 is found to partially contain precipitates. A simulation conducted using thermodynamic equilibrium computation shows that a portion where W is concentrated has a harmful phase (sigma phase) precipitated therein; thus, there is concern that embrittlement may occur when such portion is exposed to high temperatures for a long period of time. FIG. 3 shows the simulation results of computation of the precipitation behavior of intermetallic compounds of alloy 11 of an example and alloy 14 of a comparative example. This confirms a result that alloy 14 has the sigma phase and the alpha (bcc) phase precipitated therein, and there is concern about the phase stability of alloy 14 when it is used over a long period of time. In contrast, alloy 11 with a low Cr content has only the delta phase precipitated therein, and has no harmful phases precipitated therein. Alloys 15 and 16, which are comparative example, have reduced alloy components of Mo and W, and reduced alloy components of Nb and Ta, respectively, and have decreased hardness correspondingly. Thus, it is estimated that alloys 15 and 16 are less strong than the conventional alloy (alloy 13).

TABLE 1

Alloy Compositions of Samples

| | | C | Cr | Mo | Nb | Ta | Fe | Co | Ti | Al | W | Mo + ½W | Nb + Ta |
|---|---|---|---|---|---|---|---|---|---|---|---|---|---|
| Examples | Alloy 1 | 0.02 | 22.0 | 7.5 | 3.5 | 0.01 | 1.0 | 0.010 | 0.02 | 0.01 | 3.0 | 9.0 | 3.51 |
| | Alloy 2 | 0.02 | 22.0 | 4.5 | 3.5 | 0.01 | 1.0 | 0.010 | 0.02 | 0.01 | 9.0 | 9.0 | 3.51 |
| | Alloy 3 | 0.02 | 22.0 | 3.0 | 3.5 | 0.01 | 1.0 | 4.9 | 0.02 | 0.01 | 12.0 | 9.0 | 3.51 |
| | Alloy 4 | 0.02 | 21.0 | 6.0 | 3.5 | 0.01 | 1.0 | 8.0 | 0.02 | 0.02 | 12.0 | 12.0 | 3.51 |
| | Alloy 5 | 0.02 | 21.0 | 6.0 | 3.5 | 0.01 | 1.0 | 0.010 | 0.02 | 0.02 | 9.0 | 10.5 | 3.51 |
| | Alloy 6 | 0.02 | 21.0 | 6.0 | 3.5 | 0.01 | 1.0 | 0.010 | 0.02 | 0.01 | 3.0 | 7.5 | 3.51 |
| | Alloy 7 | 0.02 | 21.0 | 6.0 | 3.0 | 0.01 | 1.0 | 0.010 | 0.02 | 0.02 | 9.0 | 10.5 | 3.01 |
| | Alloy 8 | 0.08 | 21.0 | 6.0 | 1.0 | 0.01 | 1.0 | 0.010 | 0.02 | 0.02 | 12.0 | 12.0 | 1.01 |
| | Alloy 9 | 0.08 | 21.1 | 6.0 | 3.0 | 1.00 | 1.0 | 0.011 | 0.02 | 0.02 | 9.0 | 10.5 | 4.00 |
| | Alloy 10 | 0.08 | 21.0 | 3.0 | 3.0 | 1.00 | 1.0 | 0.000 | 0.02 | 0.02 | 10.0 | 8.0 | 4.00 |
| | Alloy 11 | 0.02 | 15.2 | 0.0 | 3.5 | 0.01 | 1.0 | 0.010 | 0.02 | 0.01 | 17.5 | 8.8 | 3.51 |
| | Alloy 12 | 0.02 | 15.1 | 11.0 | 3.5 | 0.01 | 1.0 | 0.010 | 0.02 | 0.01 | 3.0 | 12.5 | 3.50 |
| Comparative Examples | Alloy 13 | 0.02 | 22.5 | 9.0 | 3.5 | 0.01 | 1.0 | 0.010 | 0.02 | 0.01 | 0.0 | 9.0 | 3.51 |
| | Alloy 14 | 0.02 | 22.0 | 0.0 | 3.5 | 0.01 | 1.0 | 0.010 | 0.02 | 0.02 | 18.0 | 9.0 | 3.51 |
| | Alloy 15 | 0.02 | 22.0 | 3.0 | 3.5 | 0.01 | 1.0 | 0.011 | 0.02 | 0.01 | 6.0 | 6.0 | 3.51 |
| | Alloy 16 | 0.02 | 22.0 | 6.0 | 0.0 | 0.01 | 1.0 | 0.010 | 0.02 | 0.01 | 6.0 | 9.0 | 0.01 |

It should be noted that the present invention is not limited to the aforementioned embodiment, and includes various variations. For example, it is possible to add, remove, or substitute other structures to or from parts of the structure of the embodiment.

What is claimed is:

1. A steam turbine casting part comprising a Ni-based casting alloy consisting of a composition of, in mass %, 0.001% to 0.1% C, 15% to 23% Cr, 0% to 11.5% Mo, 3% to 18% W, 5 or less % Fe, 4.9 or less % Co, 0.4 or less % Ti, 0.4 or less % Al, at least one of Nb and Ta, and the balance being inevitable impurities and Ni, wherein $0.5\% \leq Nb+Ta \leq 4.15\%$ is satisfied, and $7\% \leq Mo+1/2W \leq 13\%$ is satisfied.

2. A steam turbine casting part comprising the Ni-based casting alloy according to claim 1, wherein a thickness of a thickest portion is 50 mm or greater.

3. A steam turbine casting part comprising the Ni-based casting alloy according to claim 1, wherein a weight of the part is 1 ton or greater.

* * * * *